US006594925B1

(12) United States Patent
Lin

(10) Patent No.: US 6,594,925 B1
(45) Date of Patent: Jul. 22, 2003

(54) IRONING BOARD AND LADDER COMBINATION

(76) Inventor: Chen-Hsiung Lin, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/112,903

(22) Filed: Mar. 29, 2002

(51) Int. Cl.[7] ..... D06F 81/02; E06C 1/393

(52) U.S. Cl. ..... 38/112; 182/31

(58) Field of Search ..... 38/112, 104, 106, 38/137; 182/129, 29, 30, 31; D32/66; D25/62, 63, 64

(56) References Cited

U.S. PATENT DOCUMENTS 1,269,102 A * 6/1918 Lewis ..... 182/31
1,284,307 A * 11/1918 Garland et al. ..... 182/29
1,599,662 A * 9/1926 Ludwikowski ..... 182/31
1,632,721 A * 6/1927 Wolf ..... 182/31
5,572,811 A * 11/1996 Lehrman ..... 38/106

* cited by examiner

*Primary Examiner*—Ismael Izaguirre

(57) ABSTRACT

An ironing board has an ironing unit and a ladder unit connected to the ironing unit. The ladder unit has a ladder frame having at least a first round hole, at least a second round hole, and at least a third round hole. The ironing unit has a pad plate, a generally U-shaped leg frame, a shelf, a generally U-shaped bracket, and a panel. A U-shaped rod is connected to the generally U-shaped leg frame. A pair of link rods are connected to the ladder frame and the panel. A first rivet fastens the generally U-shaped leg frame and the ladder frame together. A second rivet fastens the shelf, the ladder frame, and the corresponding link rod together. A third rivet fastens the pad plate and the ladder frame together. A fourth rivet fastens the corresponding link rod, the generally U-shaped bracket together. A shaft passes through the first through aperture of the pad plate and the second circular aperture of the panel.

1 Claim, 6 Drawing Sheets

IRONING BOARD AND LADDER COMBINATION

BACKGROUND OF THE INVENTION

The present invention relates to an ironing board. More particularly, the present invention relates to an ironing board which is used as a ladder/ironing board union device.

A conventional ironing board cannot be converted into a ladder. Furthermore, a ladder and the conventional ironing board cannot be folded together.

SUMMARY OF THE INVENTION

An object of the present invention is to provide an ironing board which can be converted into a ladder.

Another object of the present invention is to provide an ironing board which is used as a ladder/ironing board union device.

Accordingly, an ironing board comprises an ironing unit and a ladder unit connected to the ironing unit. The ladder unit has a ladder frame and a tread plate disposed on the ladder frame. The ladder frame has at least a first round hole, at least a second round hole, and at least a third round hole. The ironing unit has a pad plate, a generally U-shaped leg frame, a shelf, a generally U-shaped bracket, and a panel. The pad plate has at least a first through aperture and at least a second through aperture. A U-shaped rod is connected to the generally U-shaped leg frame. The generally U-shaped leg frame has at least a round aperture. The shelf has at least an end through hole. The generally U-shaped bracket has at least an end round hole. The panel has at least a pair of first circular aperture and a second circular aperture. A pair of link rods are connected to the ladder frame and the panel. Each of the link rods has a first end circular hole and a second end circular hole. A first rivet passes through the round aperture of the generally U-shaped leg frame and the first round hole of the ladder frame. A second rivet passes through the end through hole of the shelf, the second round hole of the ladder frame, and the first end circular hole of the corresponding link rod. A third rivet passes through the second through aperture of the pad plate and the third round hole of the ladder frame. A fourth rivet passes through the second end circular hole of the corresponding link rod, the first circular aperture of the panel, and the end round hole of the generally U-shaped bracket. A shaft passes through the first through aperture of the pad plate and the second circular aperture of the panel.

DETAILED DESCRIPTION OF THE INVENTION

Figure 1:
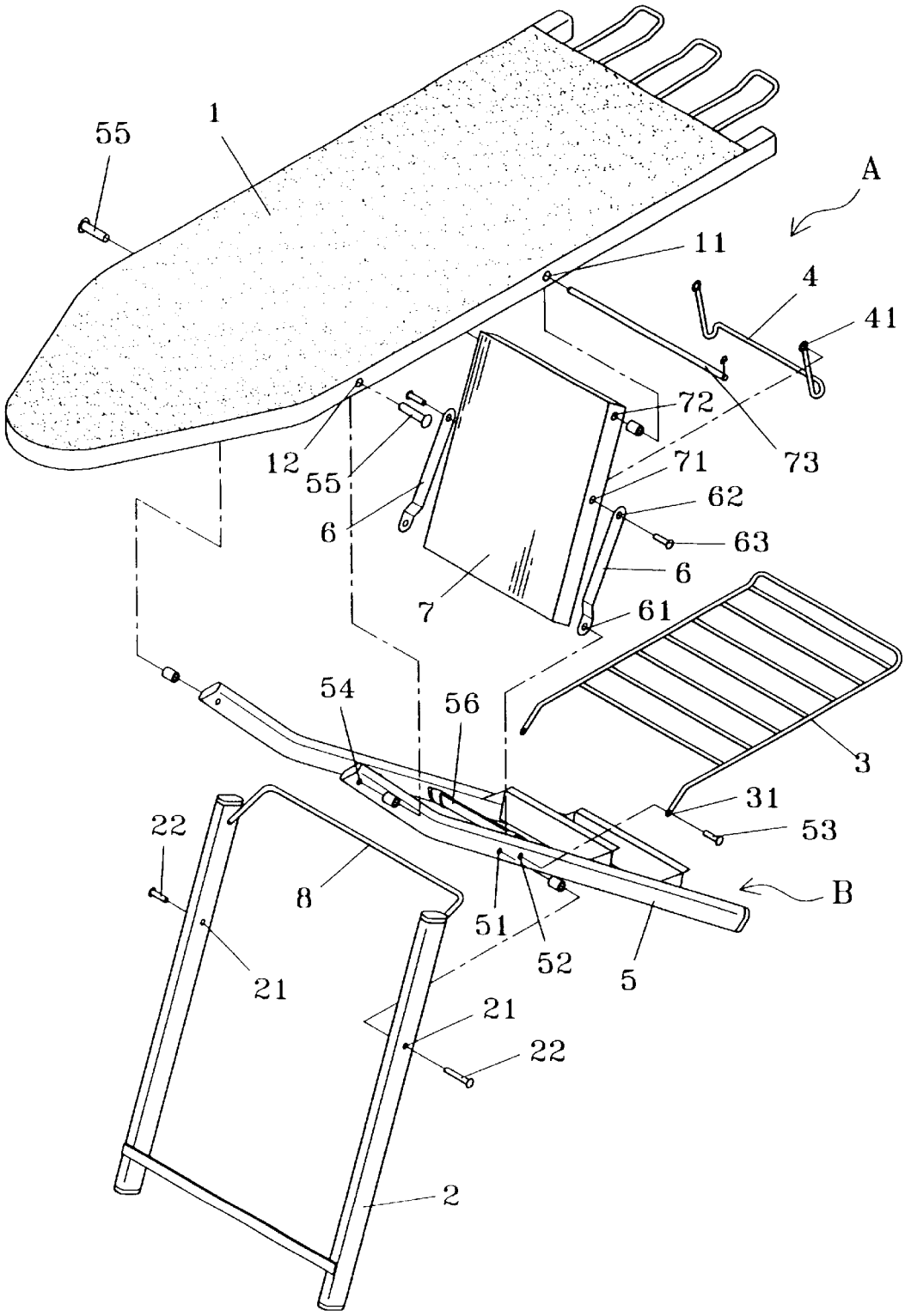
FIG. 1 is a perspective exploded view of an ironing board of a preferred embodiment in accordance with the present invention.
Figure 2:
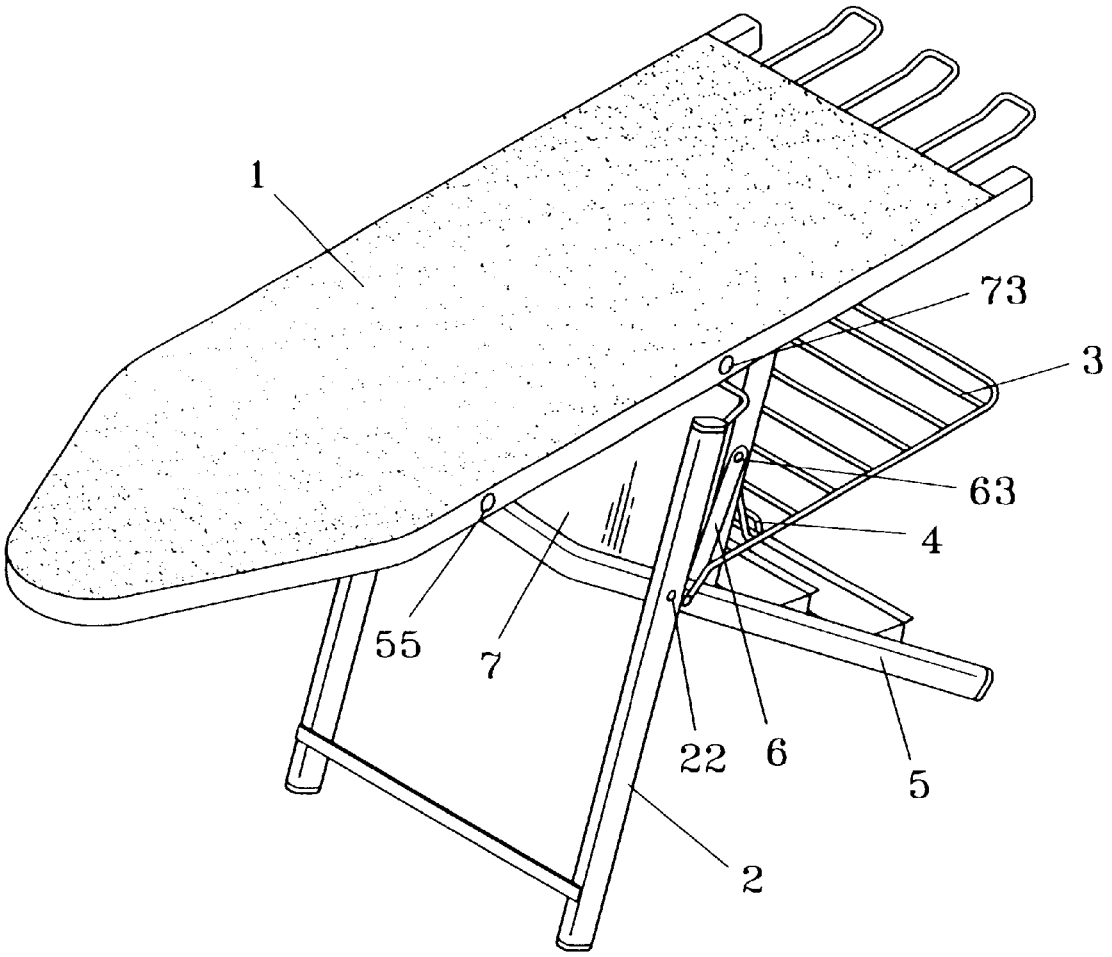
FIG. 2 is a perspective assembly view of an ironing board of a preferred embodiment in accordance with the present invention.
Figure 3:
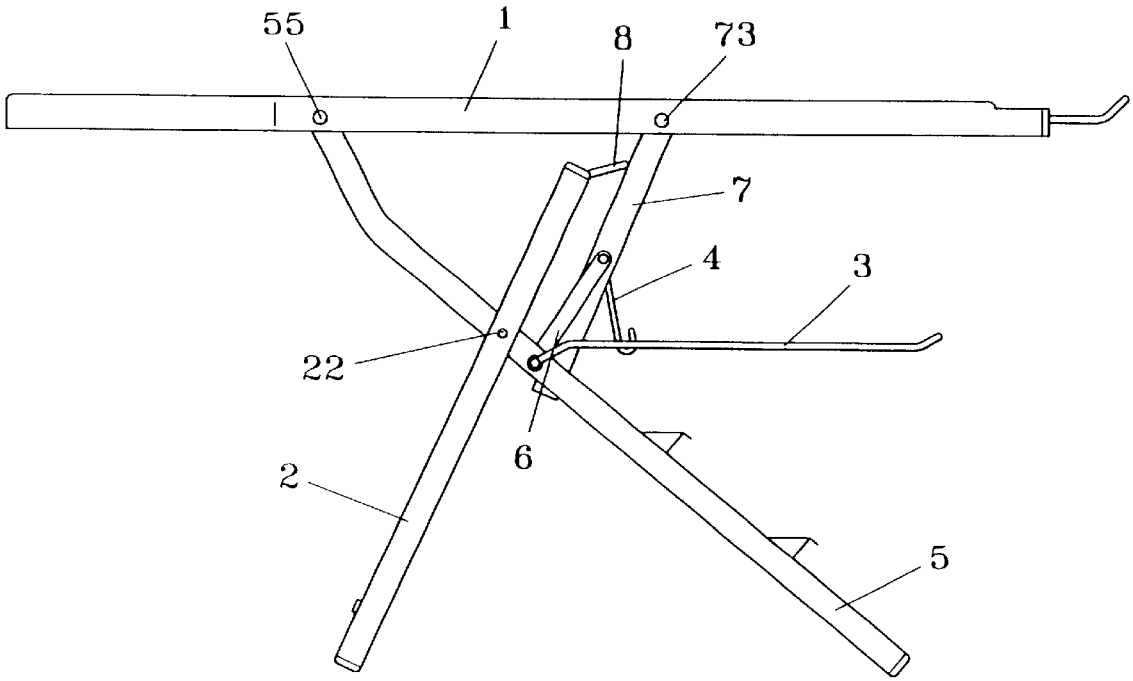
FIG. 3 is an elevational view of FIG. 2.
Figure 4:
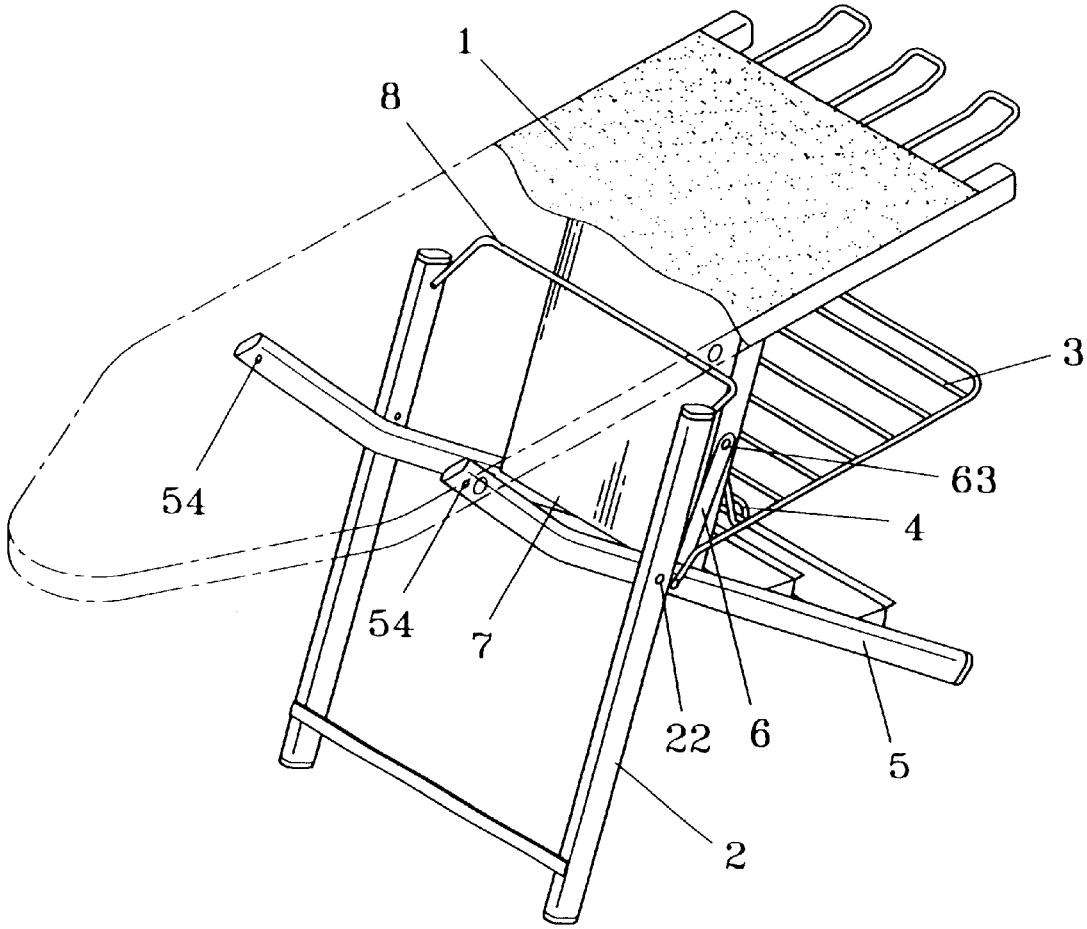
FIG. 4 is a schematic view illustrating an application of a pad plate of a preferred embodiment in accordance with the present invention.
Figure 5:
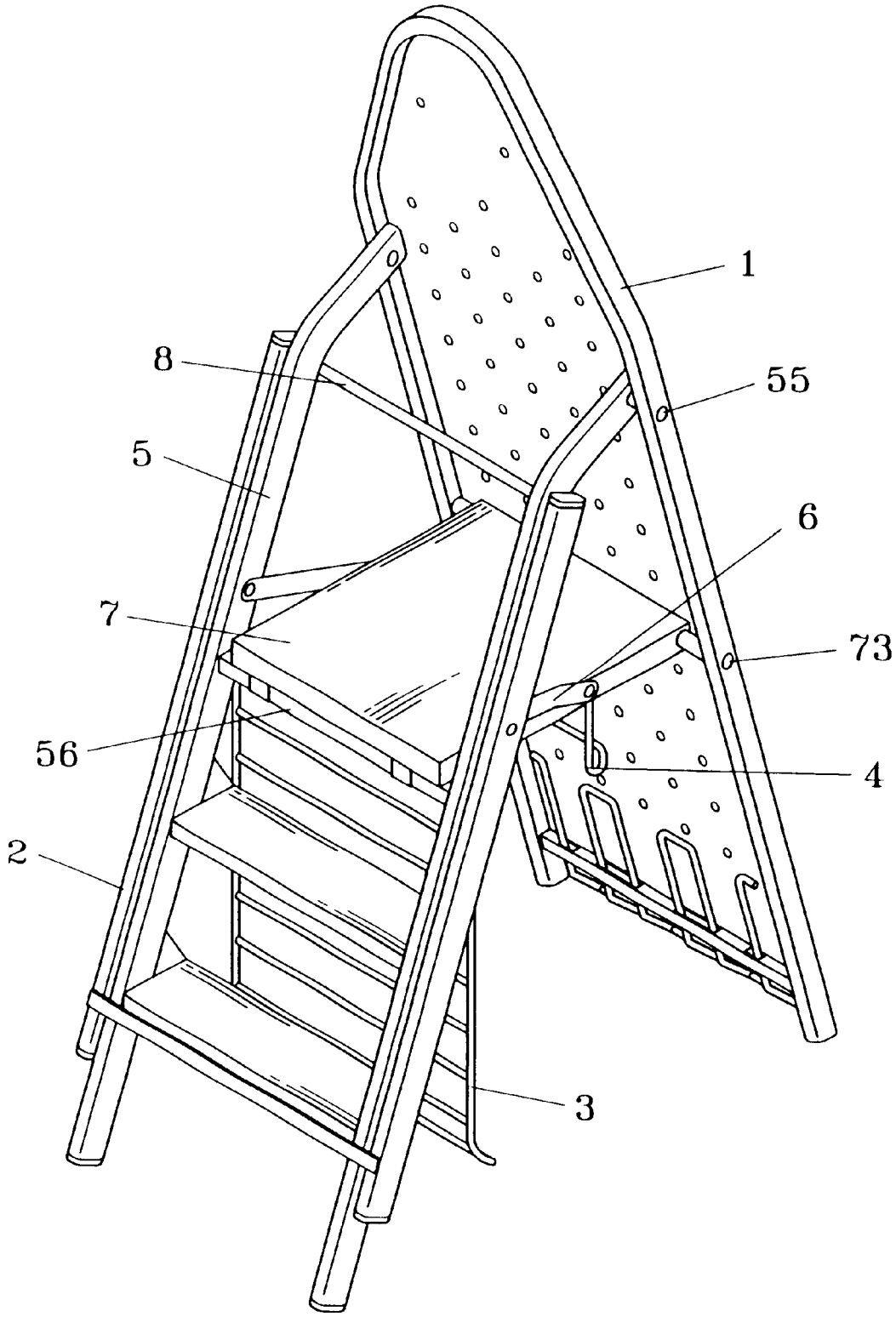
FIG. 5 is a schematic view illustrating an application of a ladder frame of a preferred embodiment in accordance with the present invention.
Figure 6:
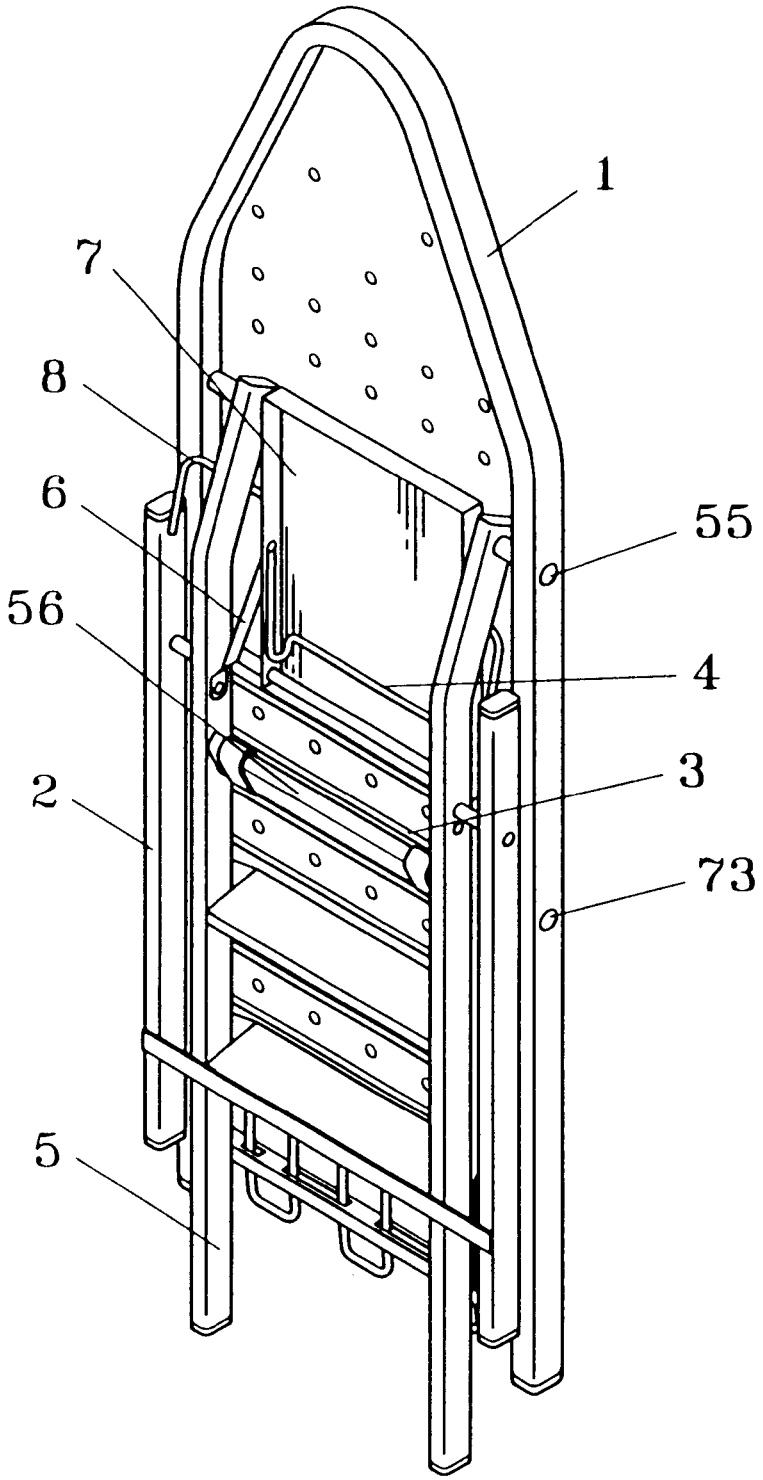
FIG. 6 is a schematic view illustrating an ironing board of a preferred embodiment is folded.

Referring to FIGS. 1 to 6, an ironing board comprises an ironing unit A and a ladder unit B connected to the ironing unit A.

The ladder unit B has a ladder frame 5 and a tread plate 56 disposed on the ladder frame 5.

The ladder frame 5 has at least a first round hole 51, at least a second round hole 52, and at least a third round hole 54.

The ironing unit A has a pad plate 1, a generally U-shaped leg frame 2, a shelf 3, a generally U-shaped bracket 4, and a panel 7.

The pad plate 1 has at least a first through aperture 11 and at least a second through aperture 12.

A U-shaped rod 8 is connected to the generally U-shaped leg frame 2.

The generally U-shaped leg frame 2 has at least a round aperture 21.

The shelf 3 has at least an end through hole 31.

The generally U-shaped bracket 4 has at least an end round hole 41.

The panel 7 has at least a pair of first circular aperture 71 and a second circular aperture 72.

A pair of link rods 6 are connected to the ladder frame 5 and the panel 7.

Each of the link rods 6 has a first end circular hole 61 and a second end circular hole 62.

A first rivet 22 passes through the round aperture 21 of the generally U-shaped leg frame 2 and the first round hole 51 of the ladder frame 5.

A second rivet 53 passes through the end through hole 31 of the shelf 3, the second round hole 52 of the ladder frame 5, and the first end circular hole 61 of the corresponding link rod 6.

A third rivet 55 passes through the second through aperture 12 of the pad plate 1 and the third round hole 54 of the ladder frame 5.

A fourth rivet 63 passes through the second end circular hole 62 of the corresponding link rod 6, the first circular aperture 71 of the panel 7, and the end round hole 41 of the generally U-shaped bracket 4.

A shaft 73 passes through the first through aperture 11 of the pad plate 1 and the second circular aperture 72 of the panel 7.

Referring to FIGS. 2 to 4 again, the panel 7 blocks the pad plate 1. The ladder frame 5 and the generally U-shaped leg frame 2 contact the ground.

Referring to FIG. 5 again, the pad plate 1 is moved downward to contact the ground. The tread plate 56 blocks the panel 7.

Referring to FIG. 6 again, the ironing board is folded.

The invention is not limited to the above embodiment but various modification thereof may be made. Further, various changes in form and detail may be made without departing from the scope of the invention.

I claim:

1. An ironing board comprises:

an ironing unit and a ladder unit connected to the ironing unit, the ladder unit having a ladder frame and a tread plate disposed on the ladder frame, the ladder frame having at least a first round hole, at least a second round hole, and at least a third round hole, the ironing unit having a pad plate, a generally U-shaped leg frame, a shelf, a generally U-shaped bracket, and a panel, the pad plate having at least a first through aperture and at least a second through aperture, a U-shaped rod connected to the generally U-shaped leg frame, the generally U-shaped leg frame having at least a round aperture, the shelf having at least an end through hole, the generally U-shaped bracket having at least an end round hole, the panel having at least a pair of first circular aperture and a second circular aperture, a pair of link rods connected to the ladder frame and the panel, each of the link rods having a first end circular hole and a second end circular hole, a first rivet passing through the round aperture of the generally U-shaped leg frame and the first round hole of the ladder frame, a second rivet passing through the end through hole of the shelf, the second round hole of the ladder frame, and the first end circular hole of the corresponding link rod, a third rivet passing through the second through aperture of the pad plate and the third round hole of the ladder frame, a fourth rivet passing through the second end circular hole of the corresponding link rod, the first circular aperture of the panel, and the end round hole of the generally U-shaped bracket, and a shaft passing through the first through aperture of the pad plate and the second circular aperture of the panel.

* * * * *